US005458243A

United States Patent [19]

McBride

[11] Patent Number: 5,458,243

[45] Date of Patent: Oct. 17, 1995

[54] MULTIPLE STACK-TRAY ASSEMBLY

[76] Inventor: Stanley B. McBride, 219 W. Sixth Ave., Lancaster, Ohio 43130

[21] Appl. No.: 306,881

[22] Filed: Sep. 15, 1994

[51] Int. Cl.[6] ..... A47F 11/00

[52] U.S. Cl. ..... 206/503; 220/23.83; 211/59.4; 211/126

[58] Field of Search ..... 220/23.83; 206/503, 206/427; 211/59.4, 126

[56] References Cited

U.S. PATENT DOCUMENTS

| | | | |
|---|---|---|---|
| 2,678,143 | 5/1954 | Dillingham et al. | 211/126 |
| 2,883,066 | 4/1959 | Pratt | 220/23.83 |
| 3,642,263 | 2/1972 | Pine et al. | 220/23.83 X |
| 3,760,974 | 9/1973 | Oglesbee | 206/427 |
| 3,888,348 | 6/1975 | Frey | 206/427 |
| 3,940,174 | 2/1976 | Mayes | 211/126 X |
| 4,688,684 | 8/1987 | Young et al. | 211/59.4 |
| 5,040,681 | 8/1991 | Grusin | 206/503 |
| 5,287,973 | 2/1994 | Bankier | 211/126 X |
| 5,294,012 | 3/1994 | Shott et al. | 220/23.83 X |

*Primary Examiner*—Steven M. Pollard
*Attorney, Agent, or Firm*—Thomas S. Baker, Jr.

[57] ABSTRACT

An adjustable assembly of multiple stack-trays is provided with a vertical support member, a multiplicity of stack-tray elements, and a multiplicity of split-collar elements which each frictionally and slidably engage the exterior surface of the support member and which each adjustable engage and support a respective one of said stack-tray elements.

7 Claims, 4 Drawing Sheets

MULTIPLE STACK-TRAY ASSEMBLY

FIELD OF THE INVENTION

This invention relates to a vertically-oriented assembly of stack-trays for holding component parts or the like, and particularly concerns a multiple stack-tray assembly that may be readily changed between open and closed stack-tray access conditions or readily secured in a fixed stack-tray open access condition.

BACKGROUND OF THE INVENTION

The use of vertically assembled stack-trays for holding component parts or other items such as perishable food items is well-known. For instance see the disclosures of U.S. Pat. Nos. 1,641,283 issued in the name of MacDougall; 2,960,250 issued in the name of Haloski; 3,298,511 issued in the name of Schertz; 3,398,827 issued in the name of Laskin; and 3,926,363 issued in the name of Catron. Such prior art references each teach an arrangement of stacked trays positioned within a container where access to a lower individual tray may be obtained only by separately removing each superimposed tray from within the container. Further, such prior art arrangements do not provide for readily changing between an open access condition and a closed access condition for any individual tray in the stacked assembly.

I have discovered that multiple stack-trays may be combined into a vertical stack assembly by use of a novel tray support arrangement that permits ready change between open access and closed access conditions for any one or more selected individual tray components in the assembly. Also, the support arrangement of my invention facilitates positioning individual stack-trays in the assembly in a condition of fixed open access.

SUMMARY OF THE INVENTION

To achieve the objects of my invention I provide a multiple stack-tray assembly with individual, and preferably compartmented, stack-trays which each have an open top and a centrally-located vertical support opening through which an assembly vertical support passes. Each centrally-located tray support opening is provided with an integral and enlarged well portion that is sized to receive a split-collar that slidably and frictionally cooperates with the assembly vertical support. A separate split collar is provided in the assembly for each stack-tray and engages its respective stack-tray in a support relation. In addition, a separate fixed clamp such as an adjustable hose clamp may be provided for each stack-tray and for cooperation with the assembly vertical support. Such fixed clamp is utilized in those instances wherein it is desired to be able to prevent rotation of a particular stack-tray or group of stack-trays in an assembly relative to the assembly vertical support member or, if the assembly vertical support member is rotatable, to cause simultaneous rotation of each clamped stack-tray with the rotated vertical support member.

Other advantages of my invention will become apparent during a careful consideration of the drawings, detailed description, and claims which follow.

DETAILED DESCRIPTION

Figure 1:
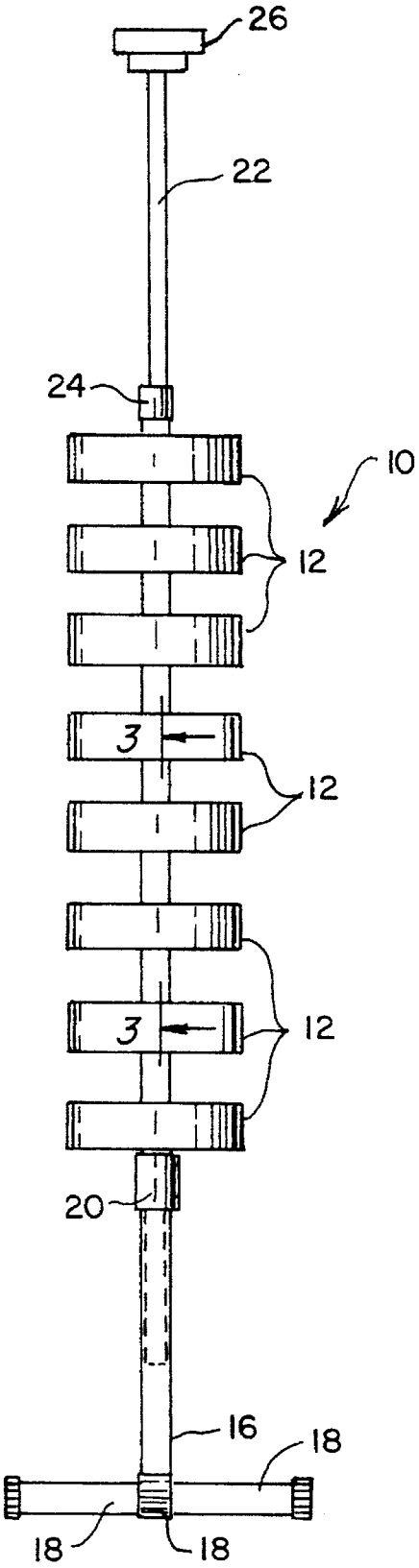
FIG. 1 is a schematic elevational view of a vertical assembly of stack-trays in which the individual stack-trays have been separated to provide ready open access to each stack-tray.
Figure 2:
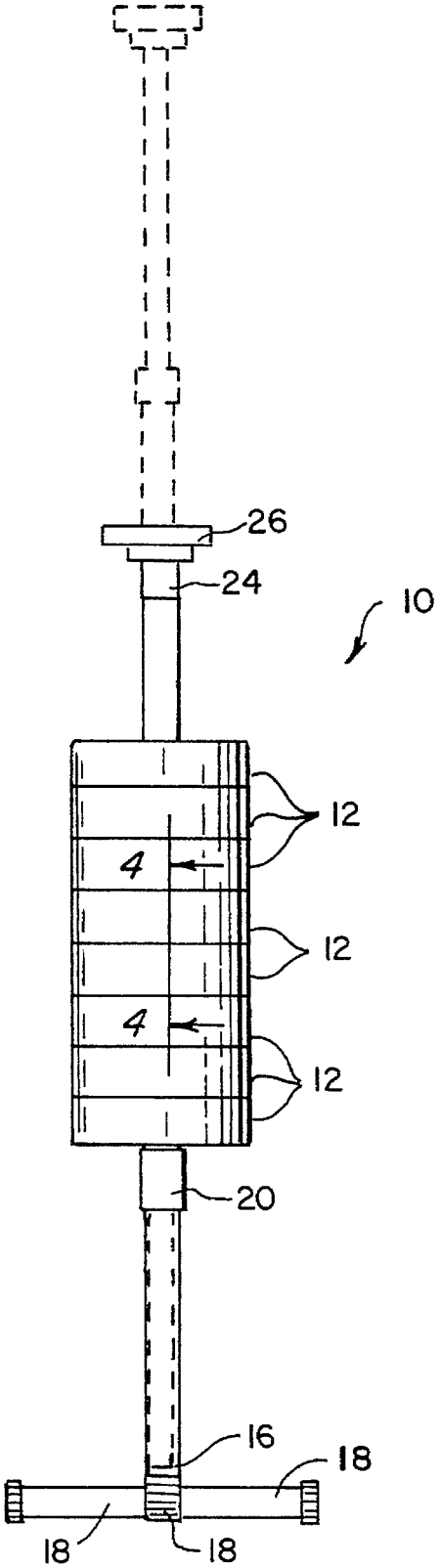
FIG. 2 is a schematic elevational view of the vertical assembly of FIG. 1 but with the individual stack-trays being stacked for closed access to all trays except the uppermost stack-tray.

FIGS. 1 and 2 schematically illustrate a preferred embodiment of my multiple stack-tray assembly invention and such is referenced generally in the drawings by the reference numeral (10). Assembly (10) is basically comprised of a grouping of individual stack-tray elements (12) (totaling eight in number in each of FIGS. 1 and 2) and a vertical support member (14) which cooperates with each stack tray element as hereinafter described. The lowermost extreme of support member (14) in each instance is supported by a base assembly (16) that includes integral and radially oriented foot members (18) and a conventional compression fitting (20) that receives and cooperates with vertical support member (14) to adjust the length thereof. Also as shown in FIGS. 1 and 2, the uppermost extreme of support member (14) in each instance is coupled to a vertically adjustable stabilizer assembly (22) received within member (14) and having a compression fitting designated (24) to adjust the length thereof. In FIG. 2, assembly (10) is shown in solid lines in a collapsed position for ease of transport and shown in dotted lines in the extended position. Base assembly (16) and stabilizer assembly (22) both may be extended and retracted within support member (14).

It should be pointed out that base assembly (16), stabilizer assembly (22) and support member (14), are preferably fabricated of a Schedule 80 PVC (polyvinylchloride) pipe or conduit and pipe fittings. In the case of vertical support member (14), the pipe or conduit has a nominal one-inch outside diameter. Alternatively, assemblies (16 and 22) and support member (14) may be fabricated of conventional galvanized iron pipe and pipe fittings. Foot members (18) normally are floor-supported whereas the upper pad (26) of assembly (22) normally is placed in contact with a room ceiling. As previously indicated, FIGS. 1 and 2 differ in that the stack-trays (12) of FIG. 1 are each spaced-apart from its adjacent stack-tray to give open access to the tray interior through the tray top whereas the stack-trays (12) of FIG. 2 are stacked in contact with each other to close access to the tray interiors (except for the uppermost stack-tray, and unless it is provided with an optional tray cover).

Figure 3:
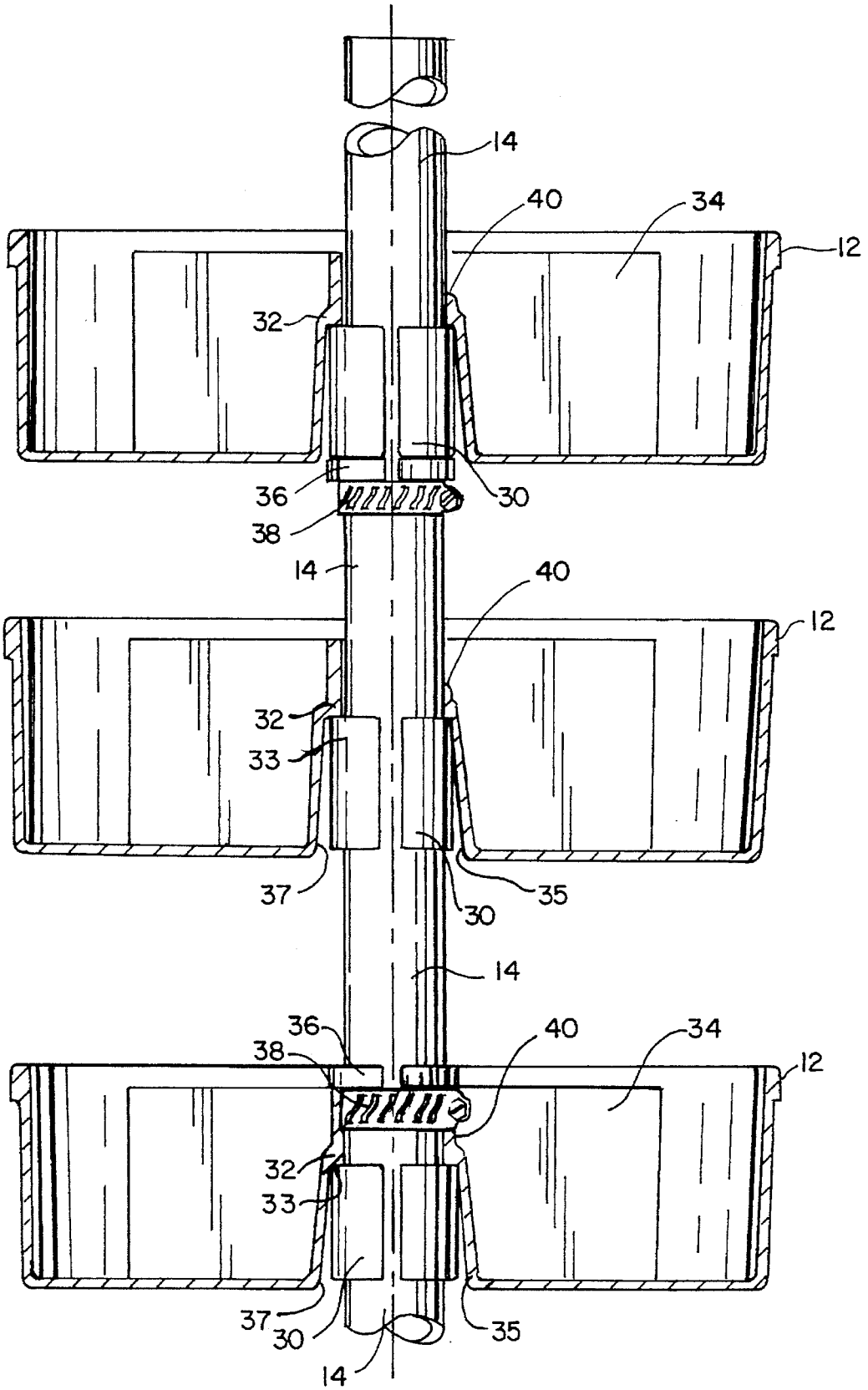
FIG. 3 is an enlarged and partially-sectioned view of the stack-tray assembly taken along the line 3—3 of FIG. 1.
Figure 4:
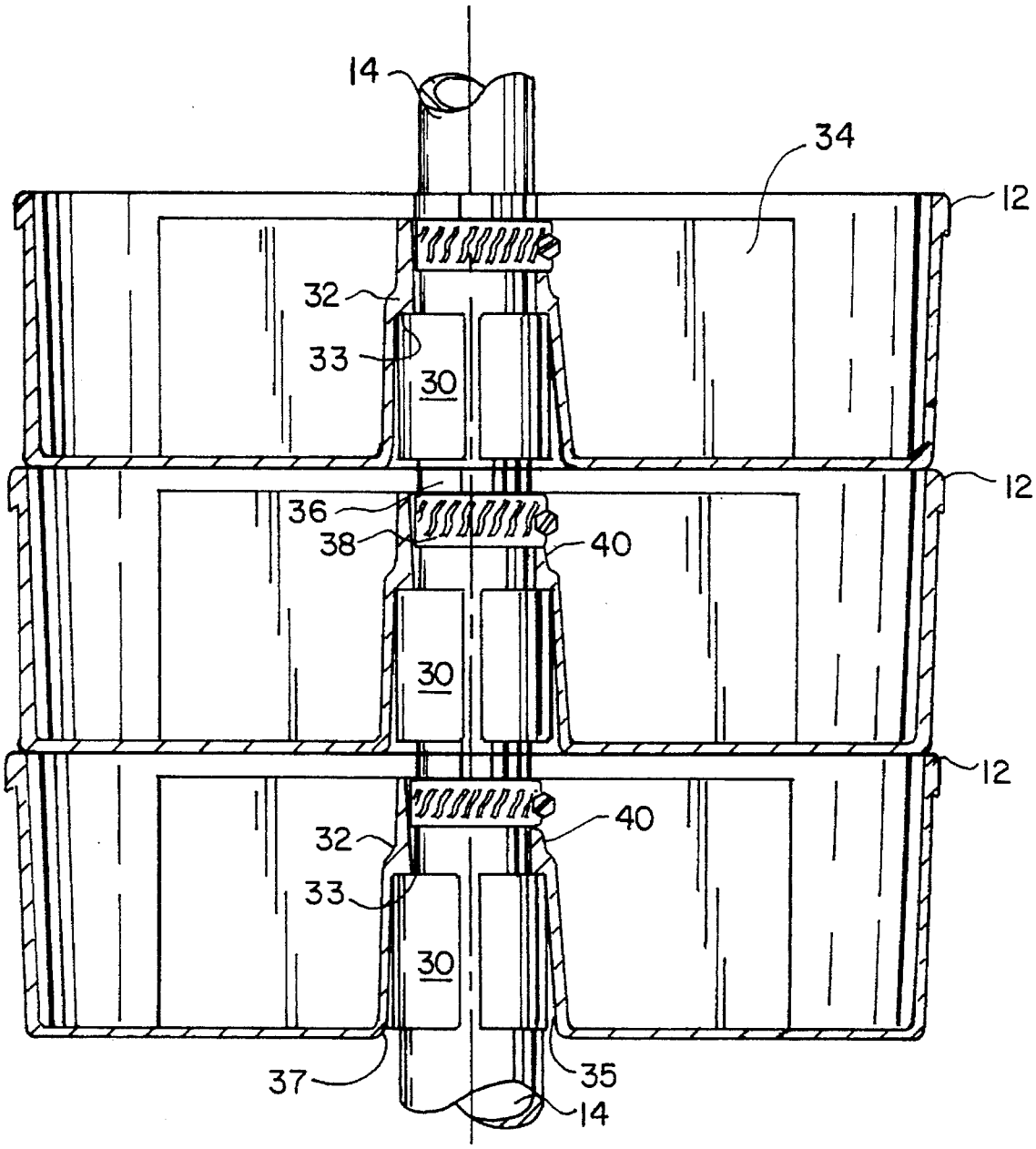
FIG. 4 is an enlarged and partially-sectioned view of the stack-tray assembly taken along the line 4—4 of FIG. 2.

Partially-sectioned FIG. 3 illustrates additional features of assembly (10) in greater detail and particularly shows the inclusion of split-collar elements (30) that each co-operates with a respective stack-tray element (12) to support that stack-tray element in a preferred position along support member (14). Each split-collar element (30) in assembly (10) is preferably made from a piece of PVC pipe cut to proper length, frictionally and slidably engages the exterior surface of vertical support pipe element (14). Additionally, split collar element (30) is received within an enlarged and stepped tubular well (32) integrally formed in the central region of stack-tray element (12). Split-collar element (30)

engages a shoulder (33) of the stepped well (32) in stack-tray element (12). The side wall (35) of stepped well (32) preferably is longer than the split-collar element (30) such that element (30) resides entirely within stepped well (32) and does not project below the bottom surface of stack-tray (12). This enables the stack-tray elements (12) to abut each other when they are stacked for closed access as depicted in FIGS. 2 and 4. It should be noted that each stack-tray element (12) is preferably formed by injection molding using a conventional thermoplastic resin such as high-density polyethylene, and also is preferably provided with integrally-formed and radially-oriented section dividers (34). It also should be noted that the diameter of the internal surface (37) of the stepped tubular well (32) is greater than the exterior dimension of vertical support element (14) and split-collar element (30) to facilitate sliding movement of each split-collar element (30) and its respective stack-tray element (12) in vertical directions. Each split-collar element (30), however, retains a snug but yet yielding frictionally engaged fit with vertical support element (14) that is sufficient to support the weight of its stack-tray (12) and the items or component parts stored therein at any desired location along vertical support element (14). In one actual embodiment of my invention I fabricated and utilized split-collar elements that were made from 1¼ inch diameter PVC pipe cut to a length of 1 ¼ inches and provided with a longitudinal split. Such split-collar elements, when engaged with a vertical support element (14) fabricated of 1 inch diameter PVC pipe, were each capable of supporting a loaded-stack tray element (12) weighing a total of 12 pounds. If the length of elements (30) were increased to 1¾ inches, the individual split-collar element load-carrying capacity is increased to approximately 30 pounds.

Figure 5:
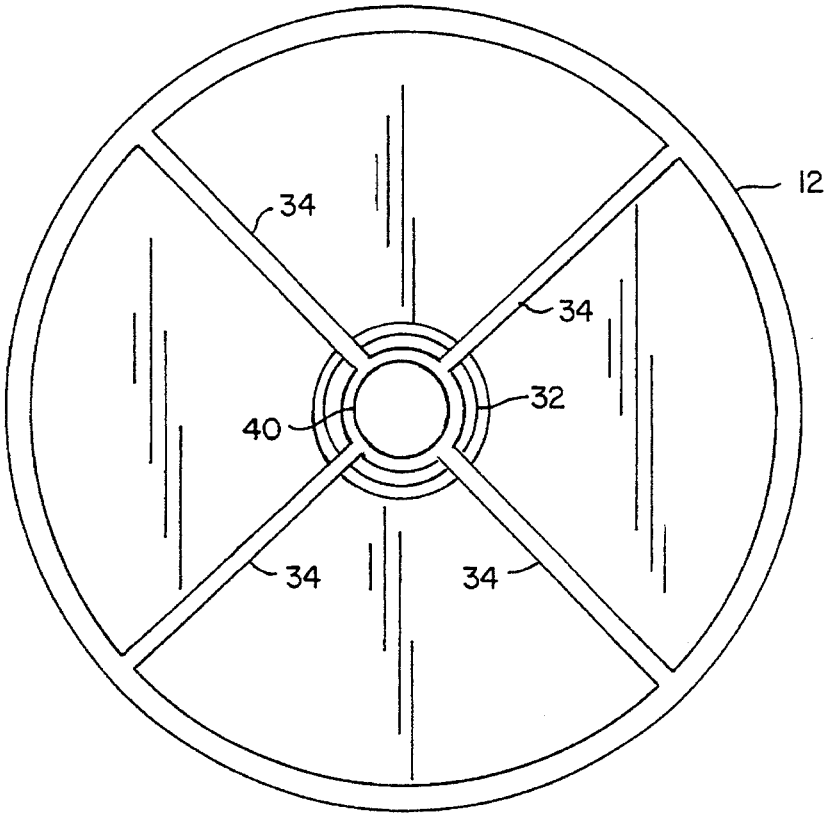
FIG. 5 is a plan view of one of the compartmented stack-trays of FIGS. 1 through 4.

Also illustrated in FIGS. 3 and 4 are the optional-use elements (36 and 38). Such elements, when utilized in assembly (10), function to "lock" their respective stack-tray element (12) in a fixed elevational position and also to prevent rotation of the stack-tray element relative to vertical support member (14). Element (36) is essentially a relatively short spacer similar to its co-operating split-collar element (30), and element (38) is a conventional expandable hose clamp that tightly engages the surface of vertical support element (14). In order to accommodate the screw mechanism of hose clamp element (38) when the stack-trays are manually moved to their stacked condition (FIG. 4), each stack-tray element is provided with a properly sized "notch" relief (40) in the upper edge of central tubular well (32). Thus, clamp element (38) operates to prevent rotation of stack-tray (12) when it resides within relief (40). See FIG. 5 for the positioning of relief (40) in the stack-tray element tubular well (32) intermediate two adjacent divider partitions (34). It should be noted that spacer element (36) and clamp element (38) both are received completely within the upper portion of central tubular well (32) of a stack-tray (12). This enables the stack-tray elements (12) to abut each other when they are stacked for closed access as depicted in FIGS. 2 and 4. Each spacer element (36) and clamp element (38) assembly housed in one stack-tray (12) operate to fixedly support the adjacent stack-tray (12) immediately above it.

Figure 6:
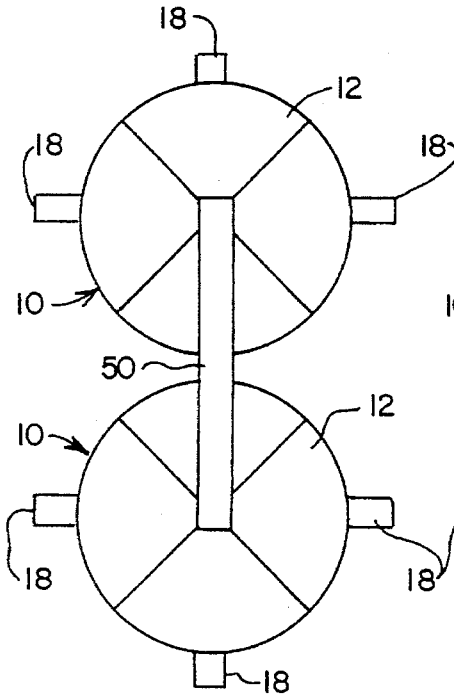
FIGS. 6 and 7 are plan views of alternate arrangements of stacked stack-trays useful in the practice of this invention.
Figure 7:
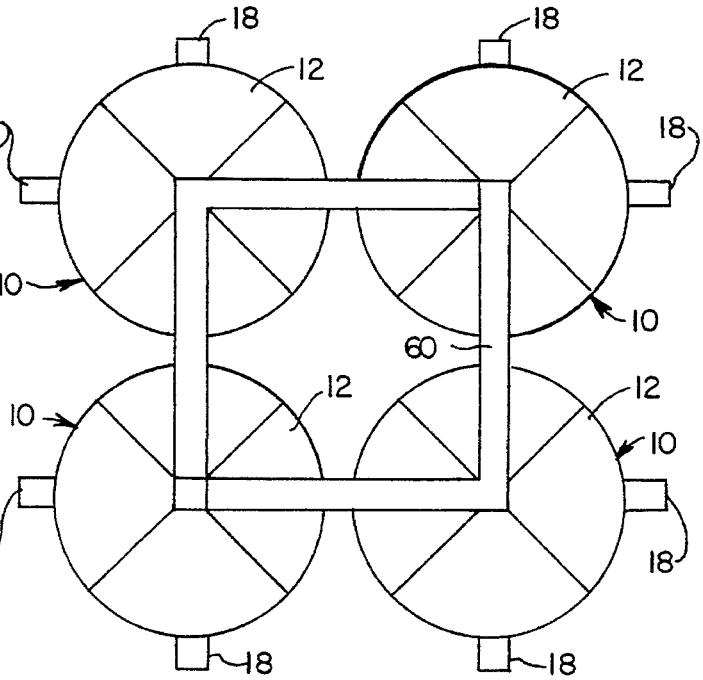

Two additional arrangements of multiple stack-trays are schematically illustrated in FIGS. 6 and 7, each arrangement primarily being merely floor-supported. FIG. 6 illustrates an arrangement of two adjacent assemblies (10) of stack-tray elements (12) joined at their tops by cross-bar element (50). FIG. 7 illustrates an arrangement of four adjacent assemblies (10) of stack-tray elements (12) joined at their tops by a rectangular (square) frame element (60) to provide for additional arrangement stability.

It will be appreciated that the individual stack-tray elements (12) in assemblies (10) may be selectively and easily moved between the various open access and closed access conditions illustrated in FIGS. 1 and 2 and in FIGS. 3 and 4 using manual forces that necessarily need only exceed the frictional engagement forces created between the different split-collar elements (30) and vertical support member (14).

Other materials, component shapes, and component sizes may be utilized in the practice of this invention without departing from the scope of the following claims.

I claim my invention as follows.

1. An adjustable assembly of multiple stack-tray elements, comprising:

a vertically-oriented support member;

a multiplicity of vertically-aligned stack-tray elements which each are provided with a central stepped tubular opening which receives said support member; and a multiplicity of split-collar elements which each co-operate with said support member and with a respective one of said stack-tray elements, each said split-collar element frictionally and slidably engaging the exterior surface of said support member.

2. The assembly of multiple stack-tray elements defined by claim 1 wherein each said stack-tray element central stepped tubular opening receives a respective one of said split-collar elements.

3. The assembly of multiple stack-tray elements defined by claim 2 wherein each said split-collar element engages a shoulder which partially defines its respective stack-tray element central stepped tubular opening to support said stack-tray element in a set position along said vertical support member.

4. The assembly of multiple stack-tray elements defined by claim 2 further comprises a side wall which partially defines said stack-tray element central stepped tubular opening and said side wall has a greater length than said split-collar element such that said split-collar element resides entirely within said stack-tray element.

5. The assembly of multiple stack-tray elements defined by claim 1 and further comprising a multiplicity of adjustable clamp elements, said clamp elements each being clamped to said vertical support member and being co-operatively engaged with a respective one of said stack-tray element central stepped tubular openings to prevent vertical movement of the engaged stack-tray member relative to said vertically-oriented support member.

6. The assembly of multiple stack-tray elements defined by claim 5 wherein each said stack-tray element central stepped tubular opening receives a respective one of said clamp elements.

7. The assembly of multiple stack-tray elements defined by claim 6 wherein each said stack-tray element central stepped tubular opening has a relief notch which receives a portion of said clamp element and prevents rotation of said stack-tray element.

* * * * *